US010686271B2

(12) United States Patent
Schaeuble et al.

(10) Patent No.: US 10,686,271 B2
(45) Date of Patent: Jun. 16, 2020

(54) CONTACT ELEMENT FOR PRODUCING AN ELECTRIC CONNECTION WITH A COUNTERPART ELEMENT, THE ELECTRIC CONNECTION, AND WINDSCREEN WIPER MOTOR

(71) Applicant: Valeo Systémes d'Essuyage, Le Mesnil Saint Denis (FR)

(72) Inventors: Michael Schaeuble, Bietigheim-Bissingen (DE); Harald Kapitza, Bietigheim-Bissingen (DE); Karl-Heinz Susser, Bietigheim-Bissingen (DE); Siegfried Stefani, Bietigheim-Bissingen (DE); Markus Stubbe, Bietigheim-Bissingen (DE)

(73) Assignee: Valeo Systèmes d'Essuyage, Le Mesnil Saint Denis (FR)

( * ) Notice: Subject to any disclaimer, the term of this patent is extended or adjusted under 35 U.S.C. 154(b) by 0 days.

(21) Appl. No.: 16/098,521

(22) PCT Filed: Apr. 28, 2017

(86) PCT No.: PCT/EP2017/060176
§ 371 (c)(1),
(2) Date: Nov. 2, 2018

(87) PCT Pub. No.: WO2017/191046
PCT Pub. Date: Nov. 9, 2017

(65) Prior Publication Data

US 2019/0148866 A1 May 16, 2019

(30) Foreign Application Priority Data

May 2, 2016 (DE) ..... 10 2016 108 069

(51) Int. Cl.
*H01R 13/115* (2006.01)
*H01R 13/11* (2006.01)
(Continued)

(52) U.S. Cl.
CPC ..... *H01R 13/115* (2013.01); *H01R 13/113* (2013.01); *H01R 13/20* (2013.01); *H01R 4/10* (2013.01)

(58) Field of Classification Search
CPC ... H01R 13/115; H01R 13/113; H01R 13/114; H01R 13/20
See application file for complete search history.

(56) References Cited

U.S. PATENT DOCUMENTS 4,795,379 A * 1/1989 Sasaki ..... H01R 13/11 439/856
4,995,814 A * 2/1991 Weidler ..... H01R 25/162 439/513
6,102,754 A * 8/2000 Capper ..... H01R 13/113 439/517
6,224,432 B1 * 5/2001 Billman ..... H01R 13/112 439/856
6,548,934 B1 4/2003 Porter et al.
(Continued)

FOREIGN PATENT DOCUMENTS

CN 104 143 716 A 11/2014
CN 205 016 725 U 2/2016

OTHER PUBLICATIONS

International Search Report issued in PCT/EP2017/060176 dated Jul. 6, 2017 (2 pages).
(Continued)

*Primary Examiner* — Briggitte R. Hammond
(74) *Attorney, Agent, or Firm* — Osha Liang LLP

(57) ABSTRACT

The invention concerns a contact element (10; 10*a*) for forming an electric connection (1) with a counterpart ele-
(Continued)

Figure 1:
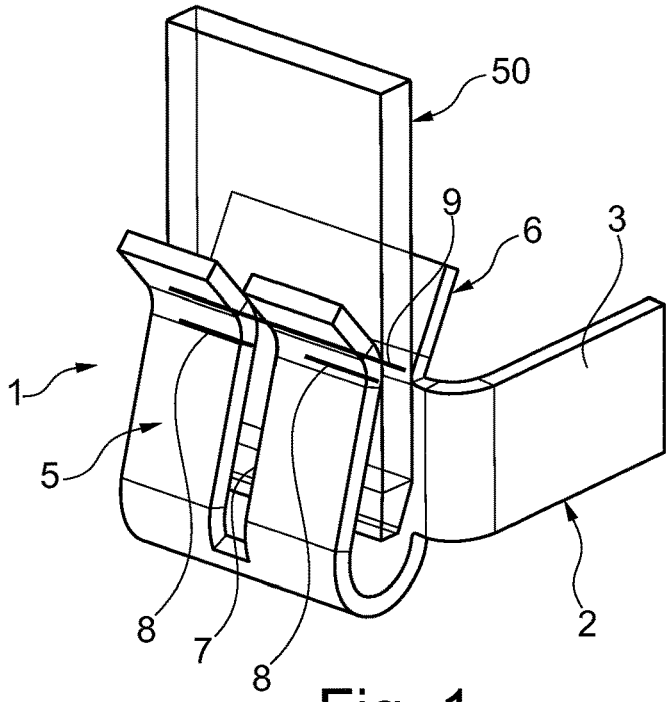

ment (50), wherein the contact element (10; 0*a*) has at least two sections (12; 12*a,* 13; 13*a*) with respectively at least one contact region (21; 21*a,* 22; 22*a,* 22*b;* 23; 23*a*), wherein the sections (12; 12*a,* 13; 3*a*) are constructed to bear against the counterpart element (50) under elastic pre-stress, and wherein the at least two contact regions (21; 21*a,* 22; 22*a,* 22*b;* 23; 23*a*) are arranged on mutually facing sides of the sections (12; 12*a,* 13; 13*a*) with respect to a longitudinal plane (25) of the contact element (10; 10*a*) defined by two axes (X, Y) arranged perpendicular to each other. According to the invention, at least one third contact region (23; 23*a*) is provided, which is constructed to bear against the counterpart element (50) under elastic pre-stress, and the at least one third contact region (23; 23*a*) is arranged at a different position at least relative to one of the other contact regions (21; 21*a,* 22; 22*a,* 22*b*) in regard to an axis (Y) of the longitudinal plane (25) of the contact element (10; 10*a*).

13 Claims, 3 Drawing Sheets

(51) Int. Cl.
*H01R 13/20* (2006.01)
*H01R 4/10* (2006.01)

(56) References Cited

U.S. PATENT DOCUMENTS

| | | | | |
|---|---|---|---|---|
| 6,722,926 | B2 * | 4/2004 | Chevassmore | H01R 13/113 439/721 |
| 6,776,635 | B2 * | 8/2004 | Blanchfield | H01R 12/7088 439/181 |
| 6,932,660 | B2 * | 8/2005 | Roepke | H01M 2/20 439/856 |
| 8,920,201 | B2 * | 12/2014 | Byrne | H01R 11/22 439/861 |
| 9,711,921 | B2 * | 7/2017 | Byrne | H01R 24/76 |
| 9,711,926 | B2 * | 7/2017 | Belanger, Jr. | B33Y 80/00 |
| 9,831,580 | B2 * | 11/2017 | Mitteer | H01R 12/737 |
| 10,050,394 | B2 * | 8/2018 | Aporius | H01R 12/7088 |
| 2005/0014423 | A1 | 1/2005 | Roepke | |
| 2012/0156947 | A1 * | 6/2012 | Tyler | H01R 13/113 439/842 |

OTHER PUBLICATIONS

Written Opinion of the International Searching Authority issued in PCT/EP2017/060176 dated Jul. 6, 2017 (6 pages).

* cited by examiner

CONTACT ELEMENT FOR PRODUCING AN ELECTRIC CONNECTION WITH A COUNTERPART ELEMENT, THE ELECTRIC CONNECTION, AND WINDSCREEN WIPER MOTOR

PRIOR ART

The invention concerns a contact element for producing an electric connection with a counterpart element according to the preamble of claim 1. Moreover, the invention concerns an electric connection making use of a contact element according to the invention, as well as a windscreen wiper motor with an electric connection.

A contact element for producing an electric connection with a counterpart element according to the preamble of claim 1 is known from U.S. Pat. No. 6,548,934 B1. The known contact element serves to produce an electric connection between a carbon element of a commutator of an electric motor and a plate or strip-shaped counterpart element, for example, one which is part of a circuit substrate. For this, the known contact element has two tongue-shaped sections joined to each other by a bending process to form a single piece, forming line-shaped contact regions on mutually facing sides which bear against opposite sides of the counterpart element under a pre-stress. For this, it is provided that the counterpart element is shoved into a slot formed between the two sections, the two sections being bent away from each other and thereby bearing against the counterpart element under a pre-stress.

It is important in the known contact element that the two contact regions should bear by their full surface against the counterpart element in order to achieve a lowest possible electric junction resistance. If there is a rotation or tilting of the components relative to each other, for example, due to a deviation in the positions of the components from their nominal position, this has the result that the bearing contact between the contact element and the counterpart element is displaced or altered. This may even result in only one of the two contact surfaces of the contact element still being in bearing contact with the counterpart element. This reduces the reliability of the electric connection and increases the electric junction resistance between the components.

DISCLOSURE OF THE INVENTION

Starting from the discussed prior art, the problem which the invention proposes to solve is to modify a contact element for producing an electric connection with a counterpart element according to the preamble of claim 1 such that an improved reliability of an electric connection produced by using a contact element can be achieved, even if the actual position between the contact element and the counterpart element departs from a nominal position.

This problem is solved according to the invention in a contact element with the features of claim 1.

The invention is based on the notion of creating an additional possibility of supplying current by the formation of at least a third contact region on the contact element, making it possible for there to always be present a sufficiently large junction surface between the contact element and the counterpart element for the current supply even in a suboptimal position between the contact element and the counterpart element. In particular, the arrangement according to the invention of at least a third contact region, wherein this is arranged in a different position at least relative to one of the other contact regions in regard to one of the axes of a longitudinal plane formed between the two sections of the contact element, ensures that always at least two contact regions bear against opposite sides of the counterpart element, even in event of the mentioned twisting or tilting of the counterpart element relative to the contact element, and thus are available for supplying current.

Advantageous modifications of the contact element according to the invention for producing an electric connection with a counterpart element are shown in the subclaims. All combinations of at least two of the features disclosed in the claims, the specification, and/or the figures fall within the scope of the invention.

In order to enable a bearing of the contact region against the counterpart element even under a twisting or tilting between the contact element and the counterpart element, it is provided that the sections of the contact element are curved in the area of the contact regions. In this way, the bearing area between the contact region and the counterpart element wanders along the side of the contact element facing the counterpart element under a twisting or tilting of the components relative to each other.

A particularly secure and reliable contacting between the counterpart element and the contact element is made possible if all contact regions of the contact element are arranged at different positions relative to the one axis on the longitudinal plane defined between the two sections of the contact element.

In order to easily adjust the spring tension or the bearing force of the section of the contact element bearing against the counterpart element and furthermore to form several contact regions with different arrangement for a given structural size of the contact element, it is preferably provided that the section for producing the contact regions on the contact element has a longitudinal slot, and that a contact region is formed on the contact element on both sides of the longitudinal slot. Especially in connection with a longitudinal slot open at one end, this makes it possible in an especially simple manner to arrange or form the two contact regions arranged on both sides of the slot in different locations.

The invention also involves an electric connection between a contact element just described and a counterpart element, wherein the counterpart element is fashioned as a plate or pin with rectangular cross section. In particular, such an electric connection is realized in a windscreen wiper motor, preferably between an electric connection wire of the windscreen wiper motor and a plate-shaped circuit substrate.

Further advantages, features and details of the invention will emerge from the following description of preferred exemplary embodiments, and also with the aid of the drawing.

Figure 2:
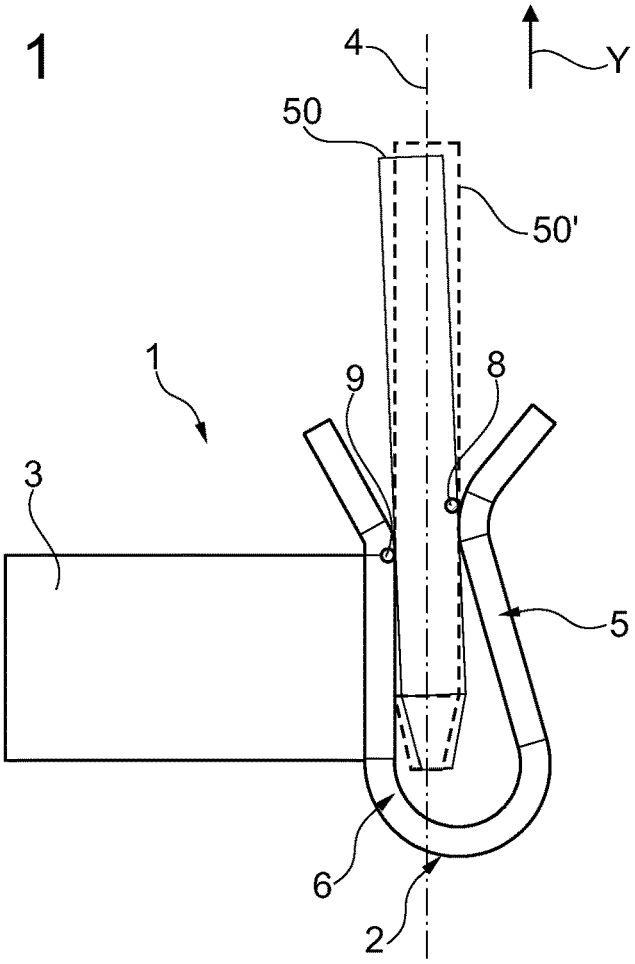
Figure 3:
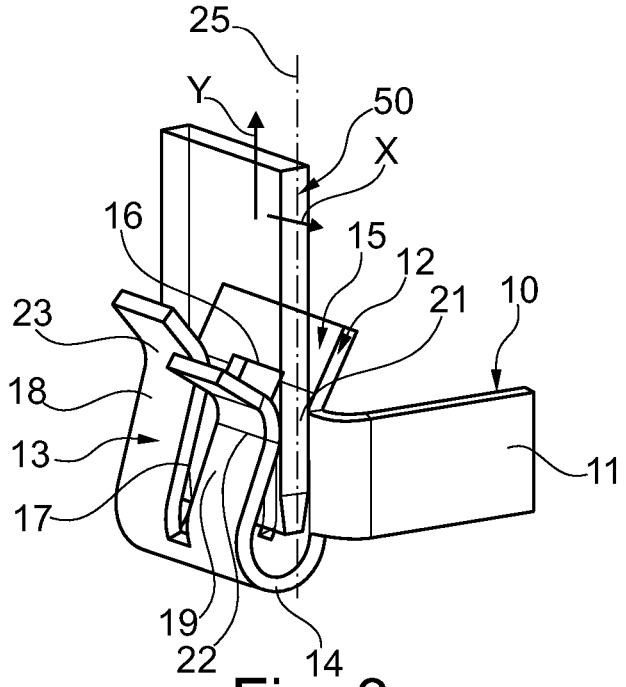
Figure 5:
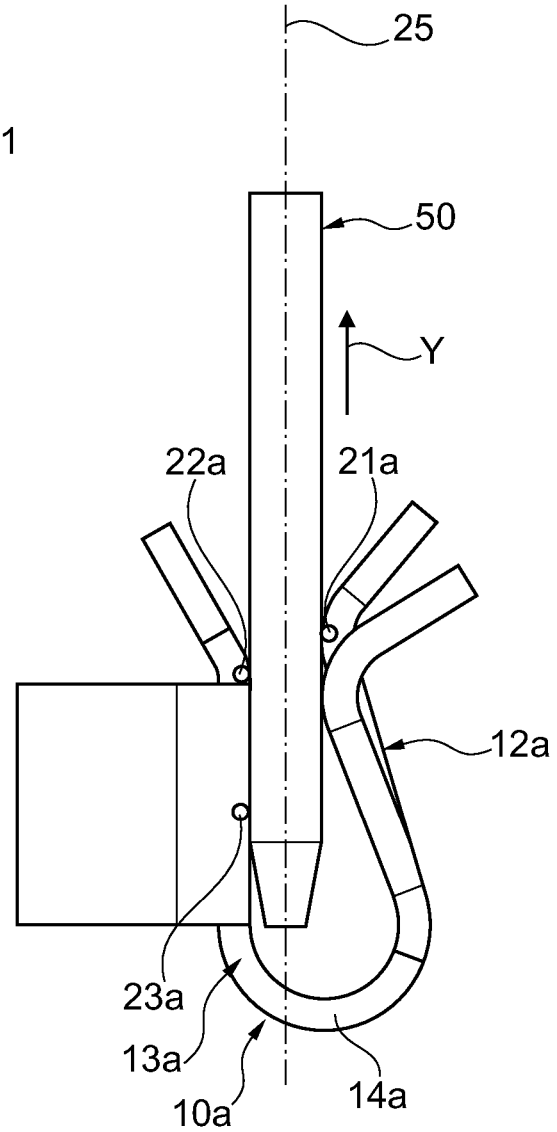
Figure 4:
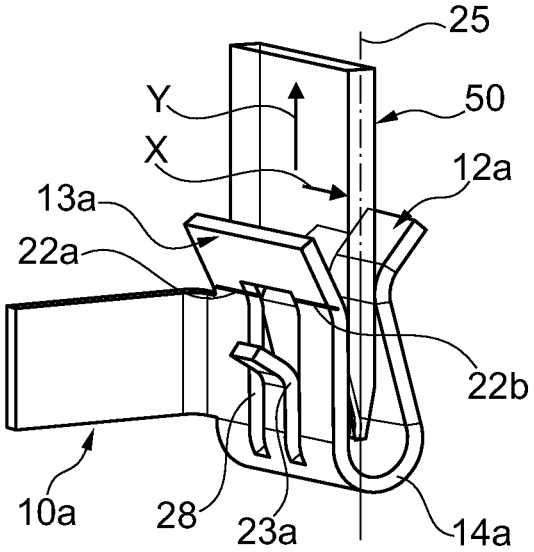

This shows:

FIG. 1 a perspective view of an electric connection between a contact element and a counterpart element according to the prior art, in which the contact element and the counterpart element are situated in an actual position relative to each other which has been swivelled and deviates from the nominal position, FIG. 2 a side view of the electric connection per FIG. 1, FIG. 3 a perspective view of an electric connection making use of a first contact element according to the invention, FIG. 4 a perspective view of an electric connection making use of a contact element modified with respect to FIG. 2 and FIG. 5 a side view of the electric connection per FIG. 4.

Figure 6:
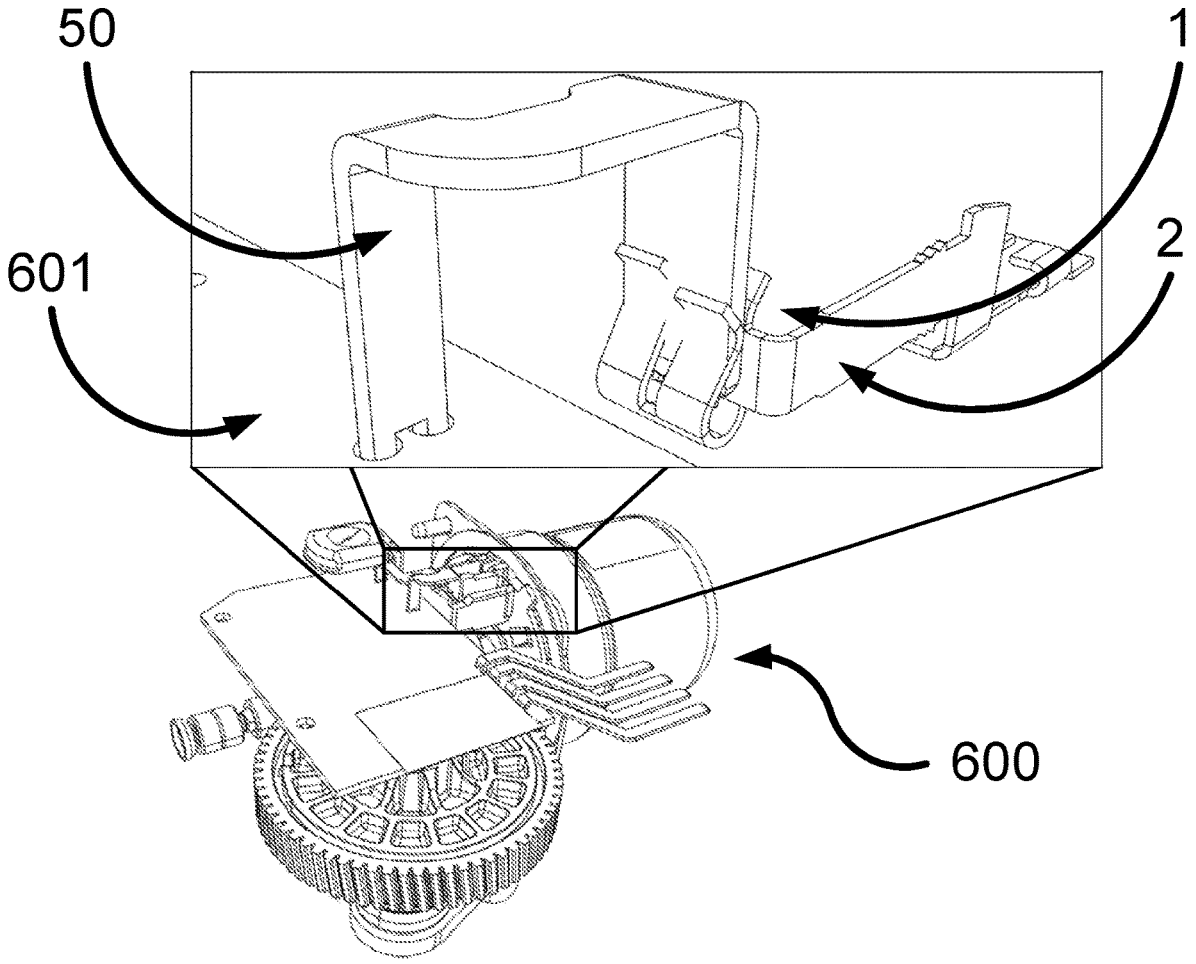

FIG. 6 a perspective view of a wiper motor with a close-up perspective view of an electric connection including a connection element.

The same elements or elements with identical function shall be given the same reference numbers in the figures.

FIGS. 1 and 2 show an electric connection 1 between a contact element 2 and a pin-shaped counterpart element 50 having a rectangular cross section at least in the area of the contact element 2 according to the prior art. The contact element 2, fashioned as a stamped/bent part, has a connection section 3, serving for example as the electric connection to an electric motor, not shown. The counterpart element 50 can be part of a circuit substrate or the like, for example.

Bent off at a right angle from the connection section 3 is an end region, having two sections 5, 6 arranged somewhat parallel to each other. In the one section 5 there is formed, for example, a longitudinal slot 7, and the two sections 5, 6 form line-shaped contact regions 8, 9 on mutually facing sides in the area of bent regions of the two sections 5, 6, which bear against the counterpart element 50 under elastic pre-stress. The elastic pre-stress is created in that the counterpart element 50 is shoved in between the two sections 5, 6.

As is particularly evident from the representation of FIG. 2, the counterpart element 50 has an actual position which is swivelled as compared to the ideal (nominal) position, indicated by the broken-line representation of the counterpart element 50', in regard to the two sections 5, 6, for example on account of manufactured parts tolerances or assembly inaccuracies. This deviation from the nominal position or nominal location of the counterpart element 50 has the effect that the two contact regions 8, 9 on the contact element 2 are situated in a different position in relation to a Y-axis of a longitudinal plane 4 extending between the two sections 5, 6 in a condition in which the counterpart element 50 is aligned with the longitudinal plane 4 or parallel to it. Thus, the two contact regions 8 separated from each other by the longitudinal slot 7 are situated above the contact region 9 in the plane of the drawing of FIG. 2.

Since due to the angle of the counterpart element 50 relative to a nominal position (counterpart element 50') there occurs at the same time a relative movement between the counterpart element 50 and the respective contact region 8, 9 in the sense of a rolling away, it is possible for the electric connection to be reduced or eliminated at one of the two contact regions 8, 9, depending on the swivel angle or tilt angle of the counterpart element 50 as compared to the nominal position per the counterpart element 50'.

FIG. 3 shows a first contact element 10 according to the invention. The contact element 10 is also formed as a stamped/bent part from a sheet metal strip or sheet metal part and it has a connection section 11. From the connection section 11 there emerge two sections 12, 13, which are joined together as a single piece by an arc-shaped connection section 14. On the side facing away from the connection section 14 there is formed an insertion slot 15 for the counterpart element 50 between the two sections 12, 13. While the one section 12 has a first longitudinal slot 16 in the form of a recess having a closed contour, there is formed on the other section 13 a second longitudinal slot 17, which emerges from the side of the section 13 facing away from the connection section 14 and extends almost to the connection section 14.

The second longitudinal slot 17 divides the section 13 into two partial regions 18, 19, the two partial regions 18, 19 having a different axial length looking in the direction of the second longitudinal slot 17. Each of the partial regions 18, 19, like the section 12, is tongue-shaped and has a curved form. In particular, the section 12 on either side of the first longitudinal slot 16 forms a first line-shaped contact region 21, while the partial region 19 of the section 13 forms a second line-shaped contact region 22 and the partial region 18 of the section 13 forms a third line-shaped contact region 23. In the area of the contact regions 21 to 23, the sections 12, 13 and the contact regions 21 to 23 are each preferably curved in the same way.

Between the two sections 12, 13 the counterpart element 50 is received under spring tensioning by the two sections 12, 13. In particular, it is also evident from FIG. 3 that the two contact regions 21, 22 of the two sections 12, 13 are located at the same Y-position in relation to the Y-axis, which extends in the longitudinal plane 25 defined between the sections 12, 13 by the X-axis and Y-axis. On the contrary, the contact region 23 on section 13 is situated above the two contact regions 21, 22 in relation to the Y-axis, i.e., in the direction facing away from the connection section 14. Furthermore, the contact regions 21 to 23 extend perpendicular to the Y-axis, i.e., in the direction of the X-axis of the longitudinal plane 25.

FIGS. 4 and 5 show a second contact element 10*a*, which differs from the first contact element 10 in that the section 13*a* has a second longitudinal slot 28, fashioned in the form of an opening, or it has a closed contour. The material remaining in the middle by the longitudinal slot 28 forms a third contact region 23*a*, situated between the two second contact regions 22*a*, 22*b* of section 13*a*. The two contact regions 22*a*, 22*b* are located at the same position in relation to the Y-axis, while the third contact region 23*a* is located in the direction of the connection section 14*a* as compared to that.

From FIG. 5 it can be seen that in addition section 12*a* is arranged or fashioned such that its contact region 21*a* is situated somewhat above the two second contact regions 22*a*, 22*b* in relation to the Y-axis, while the third contact region 23*a* of section 13*a* is arranged beneath the two second contact regions 22*a*, 22*b* and the first contact region 21*a*. Thus, the three contact regions 21*a*, 22*a* (22*b*) and 23*a* are situated in three different positions in relation to the Y-axis of the longitudinal plane 25.

From FIG. 6, it can be seen that an electric connection 1 includes the contact element 2 and a counterpart element 50. The counterpart element 50 is constructed in a plate-shaped or pin-shaped manner. As such, the counterpart element 50 may be a plate-shaped circuit substrate 610. Further, a wiper motor 600 may include the electric connection 1. The wiper motor 600 may be a motor for actuating a wiper. Thus, the electric connection 1 may be formed between an electric connection cable of the wiper motor 600 and a plate-shaped circuit substrate 610.

The described contact element 10, 10*a* can be modified in many ways without departing from the notion of the invention.

REFERENCE NUMBERS

1 Electric connection
2 Contact element
3 Connection section
4 Longitudinal plane
5 Section
6 Section
7 Longitudinal slot
8 Contact region

9 Contact region
10/*a* Contact element
11 Connection section
12/*a* Section
13/*a* Section
14 Connection section
15 Insertion slot
16 Longitudinal slot
17 Longitudinal slot
18 Partial region
19 Partial region
21/*a* First contact region
22/*a*/*b* Second contact region
23*a* Third contact region
25 Longitudinal plane
28 Longitudinal slot
50 Counterpart element

The invention claimed is:

1. A contact element for forming an electric connection with an electrically conductive counterpart element, the contact element comprising:

at least two sections with at least one contact region at each section; and at least one third contact region, wherein the sections are constructed to bear against the electrically conductive counterpart element under elastic pre-stress, wherein the at least two contact regions are arranged on mutually facing sides with respect to a longitudinal plane defined by two axis arranged at right angle of the contact element, wherein the at least one third contact region is constructed to bear against the counterpart element under elastic pre-stress, wherein the at least one third contact region is arranged at a different position at least opposite one of the other at least two contact regions with reference to an axis of the longitudinal plane of the contact element, wherein the contact element further comprises a first longitudinal end formed as free ends, and a second longitudinal end that is a U-shaped bent portion from which the at least two sections extend, and wherein one section of the at least two sections has a first longitudinal slot in the form of a recess with closed contours at both longitudinal ends of the longitudinal slot.

2. The contact element according to claim 1, wherein the contact element is constructed as a stamped/bent part, and the at least two sections are constructed tongue-like.

3. The contact element according to claim 2, wherein the sections are constructed in a bent manner in the region of the contact regions.

4. The contact element according to claim 3, wherein the contact regions are constructed linearly, wherein the contact regions run perpendicularly to an axis of the longitudinal plane.

5. The contact element according to claim 1, wherein all contact regions are arranged at a different position in the axis of the longitudinal plane.

6. The contact element according to claim 2, wherein the other section of the at least two sections has a second longitudinal slot and one contact region is constructed on both sides of the first and the second longitudinal slots.

7. The contact element according to claim 6, wherein a contact region is arranged flush with the longitudinal slot.

8. The contact element according to claim 6, wherein the second longitudinal slot is opened at one side.

9. An electric connection comprising:

the contact element according to claim 1, and a counterpart element, wherein the counterpart element is constructed in a plate- or pin-shaped manner.

10. A wiper motor, comprising the electric connection according to claim 9.

11. The wiper motor according to claim 10, wherein the electric connection is formed between an electric connection cable of the wiper motor and a plate-shaped circuit substrate.

12. A contact element for forming an electric connection with an electrically conductive counterpart element, the contact element comprising:

at least two sections with at least one contact region at each section; and at least one third contact region, wherein the sections are constructed to bear against the electrically conductive counterpart element under elastic pre-stress, wherein the at least two contact regions are arranged on mutually facing sides with respect to a longitudinal plane defined by two axis arranged at right angle of the contact element, wherein the at least one third contact region is constructed to bear against the counterpart element under elastic pre-stress, wherein the at least one third contact region is arranged at a different position at least opposite one of the other at least two contact regions with reference to an axis of the longitudinal plane of the contact element, wherein the contact element further comprises a connection section extending perpendicular to a longitudinal direction from one of the at least two sections, and wherein one section of the at least two sections has a first longitudinal slot in the form of a recess with closed contours at both longitudinal ends of the longitudinal slot.

13. A contact element for forming an electric connection with an electrically conductive counterpart element, the contact element comprising:

at least two sections with at least one contact region at each section; and at least one third contact region, wherein the sections are constructed to bear against the electrically conductive counterpart element under elastic pre-stress, wherein the at least two contact regions are arranged on mutually facing sides with respect to a longitudinal plane defined by two axis arranged at right angle of the contact element, wherein the at least one third contact region is constructed to bear against the counterpart element under elastic pre-stress, wherein the at least one third contact region is arranged at a different position at least opposite one of the other at least two contact regions with reference to an axis of the longitudinal plane of the contact element, and wherein one of the at least two sections comprises a longitudinal cutout, wherein the at least one contact region is constructed on both sides of the longitudinal cutout, wherein the longitudinal cutout has closed contours at both longitudinal ends of the longitudinal slot, and wherein the at least one third contact region is arranged inside the closed contour, extending from the longitudinal cutout.

* * * * *